US008183505B2

(12) United States Patent
Niederer et al.

(10) Patent No.: US 8,183,505 B2
(45) Date of Patent: May 22, 2012

(54) HEAT-GENERATING ELEMENT FOR AN ELECTRIC HEATING DEVICE AND METHOD FOR THE MANUFACTURE OF THE SAME

(75) Inventors: Michael Niederer, Kapellen-Drusweiler (DE); Franz Bohlender, Kandel (DE)

(73) Assignee: Catem GmbH & Co. KG, Herxheim Bei Landau (DE)

( * ) Notice: Subject to any disclaimer, the term of this patent is extended or adjusted under 35 U.S.C. 154(b) by 1235 days.

(21) Appl. No.: 11/924,269

(22) Filed: Oct. 25, 2007

(65) Prior Publication Data

US 2008/0099464 A1 May 1, 2008

(30) Foreign Application Priority Data

Oct. 25, 2006 (EP) ..... 06022338

(51) Int. Cl.
*H05B 3/06* (2006.01)
*H05B 3/44* (2006.01)

(52) U.S. Cl. ..... 219/520; 219/544

(58) Field of Classification Search ..... 219/520, 219/523, 538–544, 546–548; 392/497, 502; 338/22 R, 254, 256, 257, 272
See application file for complete search history.

(56) References Cited

U.S. PATENT DOCUMENTS

| | | | | |
|---|---|---|---|---|
| 3,940,591 | A * | 2/1976 | Ting | 219/544 |
| 4,223,208 | A * | 9/1980 | Kleinschmidt et al. | 219/530 |
| 4,700,050 | A * | 10/1987 | Hennuy et al. | 219/438 |
| 5,140,298 | A * | 8/1992 | Gordon et al. | 338/226 |
| 6,901,213 | B2 | 5/2005 | Bing | |

FOREIGN PATENT DOCUMENTS

| | | | |
|---|---|---|---|
| DE | 28 04 749 | A1 | 2/1978 |
| DE | 30 46 995 | A1 | 12/1980 |
| DE | 32 08 802 | A1 | 3/1982 |
| DE | 3208802 | A1 | 9/1983 |
| EP | 0 350 528 | A1 | 7/1988 |
| FR | 2 331 229 | | 11/1975 |
| JP | 7230874 | A | 8/1995 |
| JP | 10162940 | A | 6/1998 |

* cited by examiner

*Primary Examiner* — Sang Paik
(74) *Attorney, Agent, or Firm* — Boyle Fredrickson, S.C.

(57) ABSTRACT

A heat-generating element includes at least one PTC heating element, strip conductors lying flat on it on both sides, and a frame which forms at least one frame opening for holding the at least one PTC heating element. The frame, as a part of a housing, forms a structural unit with a wedge element having a first wedge surface that extends parallel to the strip conductor and a second wedge surface that lies exposed on the exterior side of the housing and that is aligned diagonally to the first wedge surface. For fixing the heat-generating element precisely in place in a slot in the housing, the heat-generating element has spacing surfaces positioned upstream or downstream of the at least one PTC heating element in the direction of the length of the slot. Also provided is a method of manufacturing an electric heating device.

6 Claims, 12 Drawing Sheets

HEAT-GENERATING ELEMENT FOR AN ELECTRIC HEATING DEVICE AND METHOD FOR THE MANUFACTURE OF THE SAME

BACKGROUND OF THE INVENTION

1. Field of the Invention

The invention under consideration relates to a heat-generating element with at least one PTC heating element, strip conductors lying flat on it on both sides and a frame which forms at least one frame opening for holding the at least one PTC heating element.

2. Description of the Related Art

A heat-generating element of this type is known as a part of an auxiliary heater for a motor vehicle, for example, from EP 0 350 528. Further heat-generating elements are known, for example, from DE 32 08 802, DE 30 46 995 or DE 28 04 749.

Basically, with category-defining, heat-generating elements of this type, the problem that exists is that a low transition resistance should be provided by means of good mechanical contacting between the strip conductor and the PTC element, so that a current feed to the heat-generating element is possible without substantial heating at the phase interface to the PTC element. This requirement becomes particularly relevant when the heat-generating element is to be fed with high operating voltages of roughly 500 volts or more.

In electric heating devices in this category, the strip conductor, which is usually formed by an electrically conductive metal sheet, is encapsulated by a sleeve surrounding the heat-generating element, said sleeve holding the strip conductor against the at least one PTC element with a certain pressure (according to DE 32 08 802). In this state of the art, the PTC element, with the strip conductors lying on both sides, it surrounded by a metallic sleeve, which is coated on the interior with silicone rubber so that the conductive metal sheets are held in the sleeve in an insulated manner. This arrangement alone is not sufficient for building up sufficient contact pressure to press the strip conductors against the PTC element. Accordingly, the entire layer composition is surrounded by a press plate. Consequently, the known heat-generating element is relatively sluggish, i.e., the heat generated by the PTC element is relatively poorly conducted to the exterior. The known heat-generating element accordingly has a poor degree of thermal efficiency and reacts to changing thermal conditions relatively slowly.

For heat dissipation, it is known, for example, from EP 0 350 528, to place radiator elements formed from metal sheets curved in a meandering manner on both sides of the heat-generating element. These are placed against the heat-generating element with a spring bias. Because the strip conductor is provided between the radiator element and the at least one PTC element in such a way that it moves freely, the strip conductor is held against the PTC element via the spring force. There is a problem with this configuration, however, namely that particularly when the heat-generating element is operated with high voltages, wandering leakage currents via the radiator element and/or the frame cannot be avoided. Furthermore, the current-carrying parts are exposed on the exterior of the heat-generating element, which is also questionable for safety reasons.

The heating cartridge known from DE 28 04 749, in which three heat-generating elements of this category are arranged around a cylindrical axis offset by an angle of 120°, also has the aforementioned disadvantage regarding poor heat conduction. Cylindrical circular segment pieces made of an electrically insulating material are located between the individual heat-generating elements, with each having a flow conduit cut into it for a fluid to be heated by the heating cartridge. Such a configuration is inadequate, particularly in the case of convective removal of the heat generated by the PTC element through the air. In this case, heat cannot be removed from the PTC element to the extent required.

The problem forming the basis of the invention under consideration is to specify a heat-generating element in which good contacting can be ensured between the strip conductor and the at least one PTC element. Furthermore, the invention under consideration is also to specify an electric heating device that preferably comprises the heat-generating element according to the invention, whereby the heat-generating elements are positioned accurately in this heating device. The invention under consideration should also specify a method for the manufacture of a corresponding electric heating device.

To solve the problem regarding the heat-generating element, the invention under consideration proposes to enhance a heat-generating element with at least one PTC element, strip conductors lying flat on it on both sides and a frame that forms at least one frame opening for holding the at least one PTC element and that surrounds this element by means of the formation of the frame as a part of a housing which forms a structural unit with at least one of the strip conductors as well as with a wedge element, whereby the wedge element comprises a first wedge surface that runs parallel to the strip conductor and a second wedge surface that is exposed on the exterior of the housing and that is aligned diagonally to the first wedge surface.

OBJECT OF THE INVENTION

With the invention under consideration, a heat-generating element whose housing forms a structural unit together with a wedge element is proposed. The housing comprises the frame, which circumferentially surrounds the at least one PTC heating element so that the housing firstly allows accurate positioning of the at least one PTC heating element in the heat-generating element and secondly holds the wedge element as a part of a structural unit, which means that the wedge element is fixed in place within the housing in a certain manner. This does not rule out the housing having an opening through which the wedge element can be removed. Nevertheless, however, the movement of the wedge element in various directions of movement is only possible within certain limits. The wedge element serves the interlocking of the heat-generating element between two surfaces that dissipate the heat by means of conduction, for example, surfaces of radiator elements against which the air that is to be heated flows. Because of the housing, the heat-generating element can initially be brought into an assembly position with the wedge element held therein, and in this position the wedge element must brace the heat-generating element between two heat-emitting surfaces. At the same time, the housing can comprise a further housing part, which has, for example, a strip conductor which lies on the PTC element(s) on the back side of the PTC element(s) facing away from the wedge element. The further housing part in this case is preferably provided as a part of the structural unit, i.e., it is in any case movable only within predetermined limits with respect to the housing part having the wedge element.

In a preferred development, the structural unit comprises the at least one PTC heating element and the two strip conductors. As already mentioned, the housing can consist of at least two housing parts that can be moved with respect to each other but that are not necessarily solidly connected to one another in the frame of the structural unit. In this way, the frame opening can also be partly formed by means of walls of one housing part and partially by walls of another housing part. Solely for reasons of assembly, it is advisable to provide a frame opening on one housing part, whereby this frame opening can hold the PTC heating element or elements within the frame sufficiently securely during the assembly. Furthermore, the strip conductor or conductors can be movable within the housing or individual housing parts, particularly in the direction towards and away from the at least one PTC heating element, in order to introduce with as little hindrance as possible an external contact force via the wedge element and into the layer composition comprising the at least one PTC heating element and the strip conductors lying on it. To reduce the number of parts and with a view to simple assembly, however, it is preferable to arrange only one strip conductor so that it can move within the limits inside the housing and to arrange the other strip conductor in such a way that it is fixed in place with respect to the housing.

The various parts of the layer composition, i.e., the two strip conductors lying flat on the at least one PTC element and the PTC element(s) preferably arranged one next to the other in a level are preferably held by the wedge element. This is pretensioned with respect to the at least one PTC element, either already in the preassembled state, i.e., by being held in the housing, or not until after the final assembly of the heat-generating element in a heating device. In any case, however, the wedge element is preferably arranged in such a way that it holds the aforementioned elements of the layer composition within the housing. The one wedge surface of the wedge element extends parallel to the strip conductor and can lie against this, either directly or with an insulating layer placed in between, so that the layer composition consisting of the two strip conductors and the at least one PTC element is securely held with an initial tension, as a result of which good electrical contacting is guaranteed between the two strip conductors and the at least one PTC heating element arranged between them. The second wedge surface of the wedge element, which is arranged oblique relative to the first wedge surface, lies exposed on the exterior of the housing. Accordingly, the second wedge surface is suitable for direct arrangement on a heat-emitting element, for example, on a radiator element, which is formed by a metal strip curved in a meandering manner. Alternatively, a separating plate of an electric heating device can also lie directly on the second wedge surface, through the other side of which flows a fluid, such as air or water, that is to be heated.

To brace the layer composition in the housing and/or to position the heat-generating element on the surrounding walls within an electric heating device, it is preferable for the housing to be formed with a guide in which the wedge element is held in such a way that it can be slid. The guide is preferably to be formed in such a way that when the wedge element is slid in, the second wedge surface is increasingly pressed against an opposite surface, which can, for example, also be formed by the housing, so that the wedge presses the strip conductor lying on the other side against the at least one PTC element. Wedge elements can be provided on both sides of the PTC element. Normally, however, it is sufficient for adequate initial tension of the strip conductors on both sides against the at least one PTC element to have one wedge element on one side of the at least one PTC element and to have stationary positioning, with respect to the PTC heating element which is preferably formed in one piece on the housing, of the conductor on the opposing side.

With a view to simple manufacture of the heat-generating element, it is preferable to form the guide so that it extends essentially parallel to the long side of the PTC heating element and to provide it with an opening through which the wedge element can be slid into the housing from the exterior. In this way, it is possible initially to insert a strip conductor into the housing, for example, then the PTC element(s) and then a second strip conductor on the other side of the PTC element(s), i.e. the surface thereof opposing first strip conductor. The wedge element can be slid into the housing from the exterior only after the layer composition has been introduced into the housing, whereby the result of the insertion of the wedge element is to join the layer composition, together with the wedge element, into a preassembled structural unit. Also to be understood as a structural unit of the invention under consideration is a unit in which the wedge element is arranged in such a way that it is still loosely arranged on the housing and/or is arranged in the housing in such a way that it can be removed.

The guidance of the wedge element in the housing can preferably take place by means of guide grooves that are cut into the housing and into which engage guide ridges, which are formed on the sides of the wedge element, i.e., on those front sides that connect the first wedge surface to the second wedge surface.

According to a further preferred development of the invention under consideration, the housing is formed so that it is tapered in the direction in which the wedge element is inserted. The wedge element and the housing are preferably coordinated to one another in such a way that in a holding position, in which the wedge element secures the aforementioned layer composition against falling out of the housing, the wedge element that has been slid into the housing does not protrude from this housing with its second wedge surface. In other words, in the holding position, the wedge element can secure the parts of the layer composition against falling out of the housing. The exterior of the housing on the side of the inserted wedge element is, however, formed by the housing surface, not by the wedge element, so that in the holding position, the heat-generating element according to the invention can be accurately positioned, for example, in an electric heating device. Because in the holding position the exterior sides provided in extension of the side surfaces, i.e., the exterior surfaces of the heat-generating element that extend parallel to the strip conductors, are initially formed by the housing, whose dimensions can be predetermined with the customary manufacturing tolerances. In a wedge element clamping position that lies deeper in the insertion direction than the holding position does, one of the exterior sides of the heat-generating element is, however, formed by the second wedge surface that protrudes beyond the housing. With this preferred development, it is possible initially to insert the heat-generating element with predetermined dimensions into, for example, a slot or recess of an electric heating device and then, by sliding the wedge element more deeply into the clamping position, to position the wedge element and consequently the entire heat-generating element against the heat-dissipating walls of an electric heating device, and to pretension them with respect to these walls. In this process, the parts of the layer composition are also pretensioned against one another, i.e., the strip conductors are positioned against the PTC heating element arranged between them with an initial tension and the PTC heating element is pretensioned against the interior walls of the slot.

It has proven to be advisable to dimension the wedge element in such a way that, in the holding position, it extends in the insertion direction of the wedge element across at least two-thirds of the length of the assigned strip conductor. The strip conductor is usually formed from a metal strip, so that even in this case in which a number of PTC heating elements are provided one next to the other in one level, the metal strip, together with the wedge element, already sufficiently fix the layer composition in place in the housing in the holding position, i.e., secure it so that it does not fall out.

With a view to good conduction of the heat generated by the PTC element towards the exterior, it is furthermore preferable for the wedge element to be dimensioned in such a way that, in the clamping position, it essentially fully covers the at least one PTC heating element provided in the housing. In this way it is ensured that the heat generated by the PTC element is conductively removed by the wedge element to the exterior and from there is dissipated, for example, by a radiator element lying directly on the wedge element, so that the heat-generating element has a low thermal inertia and a high degree of thermal efficiency.

Particularly for applications with high voltages, it is preferable to provide an insulating layer lying on the strip conductor, between the wedge element and the strip conductor adjacent to it. This can be formed, for example, by a plastic strip or a ceramic layer. Preferably in the arrangement of a ceramic layer adjacent to the strip conductor, a slide plate should additionally be provided between the ceramic layer and the wedge element, whereby this slide plate is preferably held stationary in the housing and whereby the wedge element slides on the slide plate when it is slid into the housing. In this way, dry friction between the wedge element and the relatively rough and brittle ceramic layer is avoided. This further development also prevents the pressing force necessary for pressing the wedge element into the housing, for example, during the final assembly of the heat-generating element in a heating device, from being significantly influenced by the frictional characteristics, as would be feared in the case in which the wedge element and the ceramic layer glide directly on each other.

According to a further preferred development of the invention under consideration, the aforementioned slide plate can additionally be provided with a different thickness for compensation of manufacturing tolerances in the layer direction of the layer composition formed by the strip conductors and the at least one PTC heating element provided between them. The necessity for such compensation of manufacturing tolerances is conceivable, for example, when a large number of heat-generating elements that are formed by identically dimensioned PTC elements, strip conductors and wedge elements, as well as the housing, are to be slid into a slot one next to the other, whereby this slot is subject to certain manufacturing tolerances. In addition, the ceramic PTC heating elements of one batch also have tolerances related to manufacturing that can be compensated by a plate with a thickness adjusted to this. Consequently, it is conceivable to classify PTC elements of one batch according to their thickness and to arrange PTC elements of the same thickness in a housing, and to compensate the dimensional deviations caused by the selection of PTC heating elements of differing thicknesses for different heat-generating elements, however, by plates of various thicknesses.

While the wedge element lies directly on the strip conductor that lies on one side of the PTC element or with an additional layer, for example, an insulating layer, preferably the strip conductor provided on the opposite side can, together with an insulating layer lying on it, preferably be connected to the housing by means of injection molding the material of the housing around the insulating layer. This creates the possibility of simply inserting the PTC elements into the housing that is already closed on one side, whereby the housing is then closed on the other side after the strip conductor has been positioned on the exterior side of the PTC heating elements with the wedge element.

According to a preferred development of the invention under consideration, the insulating layer already mentioned in the preceding, preferably formed by a ceramic plate, is used to hold the strip conductor in the frame in a manner that forms a seal. For this, the insulating layer lies on the housing in such a way as to form a seal, for example, by means of a seal provided between the insulating layer and the housing, whereby this seal can, for example, be formed by an adhesive strip which fixes the insulating layer in place on the housing. In this way, moisture is prevented from reaching the layer composition which is held in the housing, which promotes leakage currents. As far as the insulating or sealing holding of the strip conductor within the housing is taken into account in the following, this is done particularly with a view to a preferred development in which the strip conductor is formed by an elongated conducting element, for example, an elongated metal strip. A number of PTC heating elements are arranged next to one another in a level between opposing metal strips. Particularly important in this preferred development is the circumferentially sealed or insulated holding of the at least one PTC element with respect to the insulating layer. The PTC heating elements can, for example, be fixed in place with respect to the insulating layer and can be provided at a distance to the walls of the frame openings, so that leakage currents cannot drain away via the frame. In the same way, the frame opening can be lined on the interior with a highly insulating material, for example, a silicone, in order to prevent direct contacting of the electrically conductive elements of the layer composition with the electrically inferior material of the frame. The frame in this case is preferably made as an injection-moulded part from a relatively economical, non-highly insulating plastic, for example, polyamide.

For further simplification from a manufacturing point of view and with a view to a predetermined energy density when a number of heat-generating elements are built into a slot of an electric heating device, it is proposed to provide the wedge element with an insertion opening that is on an upper face side of the housing and that leads to the guide. Furthermore, contact studs leading to the strip conductors are provided on the upper side, whereby these contact studs penetrate through contact stud openings cut into the housing. The upper face side then serves the electrical connection of the heat-generating element and the insertion of the wedge element. When the heat-generating element is installed into a slot of an electric heating device, the upper face side of the housing is usually exposed at the top, so that the individual heat-generating element can be electrically connected at this upper side.

The aforementioned slot normally has a length that is a multiple of that of the heat-generating element. With a view to optimal utilisation and heating of the slot along its entire length, it is preferably proposed that the housing, on this upper face side, form spacing elements with spacing surfaces that run at right angles to the contact studs. These spacing surfaces extend in the direction of the length of the contact studs and are upstream or downstream of the at least one PTC element in the length direction.

The spacing surfaces are arranged corresponding to one another in such a way that adjacent heat-generating elements that are inserted into one and the same slot abut against one another with their front or rear spacing surfaces in a predetermined manner, in order reliably to give the desired distance between adjacent heat-generating elements.

With a view to accurate positioning of the heat-generating element in the slot, according to a further preferred development of the invention under consideration it is proposed that the housing, on its upper face side and on each side on the at least one PTC element, form a limit stop that runs at a right angle to the contact studs and in the direction of the thickness of the at least one PTC element. The maximum penetration depth of the heat-generating element into the slot is given by this limit stop. This penetration depth is reached when the limit stop abuts against the upper edge of the slot.

The aforementioned spacing surfaces and the limit stops are preferably formed as a part of a circumferential rim which preferably ends flush with the upper side of the housing and surrounds the housing on the upper side.

For simplifying the manufacture of the heat-generating element, the housing comprises a housing shell element and a housing shell counter-element, which can likewise be formed as a shell. This contemplation also particularly concentrates on the circumferential envelopment of the at least one PTC element in the case of an elongated layer composition with a number of PTC elements arranged one behind the other between metal strips. The two housing elements are connected, by means of injection molding around, to a strip conductor or, where appropriate, to an insulating layer surrounding this on the exterior. The insulating layer or strip conductor is accordingly placed as an insert into an injection mould for the manufacture of the housing shell elements. One of the housing elements, i.e., either the housing shell or the housing shell counter-element, forms the guide for the wedge element.

The housing elements are furthermore essentially immovable with respect to one another because they mesh in the insertion direction of the wedge element. For this purpose, corresponding projections and recesses, for example tabs with tab holes, can be provided on the opposing surfaces of the housing elements. These are dimensioned in such a way, however, that relative movement of the two housing elements in a direction essentially at a right angle to the insertion direction is possible. When the layer composition is pressed into a slot, the housing elements, with their respective strip conductors and possibly the insulating layers fixed in place in them, are moved relative to one another, until the strip conductors are sufficiently tightly pressed on both sides against the PTC element(s). This necessitates that the two housing elements are dimensioned in such a way that a certain gap remains between opposing outer surfaces of the housing elements before the placement of the strip conductors on the PTC elements in a manner forming a seal.

With a view to the circumferential insulation of the electrically conductive parts of the layer composition, according to a preferred development of the invention under consideration it is proposed that a compressible sealing material that seals the frame opening be provided between the two housing elements. This is dimensioned in such a way that with the conceivable relative movements for positioning the strip conductors against the PTC element by means of the compressible sealing material, a sealing of the interior holding the layer composition and cut out of the housing elements is achieved. The compressible sealing material can be formed by a rubber. It is also conceivable to provide the sealing material with certain adhesion characteristics, so that the housing elements are glued to each other by the sealing material in the prefabricated state.

Particularly in the case of the aforementioned preferred development of the heat-generating element, the housing elements are manufactured as separate components by means of injection molding and joined after the insertion of the at least one PTC element into the frame. Even just housing elements that have been pushed together are to be understood as a joined unit in the context of the invention, without it being necessary for these to be permanently or undetachably connected to each other. For example, fitting positive locking elements into one another can be understood as joining, whereby these positive locking elements essentially fix these two housing elements immovably in place relative to each other in the insertion direction of the wedge element. The housing elements joined in this way can, for example, be held in a fixed position in a heating device after being inserted into a slot. In this application, it is not necessary to fix the housing elements in place relative to one another. Naturally this does not exclude fixing the two housing elements in place, for example, by welding on tabs that are formed on one of the housing elements and that project through the other housing element and that are exposed on the exterior side of the housing element. By welding such tabs or by shoring such tabs up by means of surface-fusing, the two housing elements can be undetachably held to each other but also in such a way that they can move adequately.

With a view to simple assembly of the heat-generating element, according to a further preferred development of the invention under consideration it is proposed to form a housing projection which surrounds the frame opening for holding the at least one PTC element on one of the housing elements, which element comprises the guide for the wedge element, whereby this housing projection has projection edges that essentially extend in the insertion direction. Correspondingly to this, on the other housing element a housing recess is formed for holding the housing projection. The housing recess and the housing projection are formed corresponding to each other in such a way that the housing projection just fits into the housing recess. In this way, the two housing elements are fixed in place against each other at a right angle to the insertion direction. For easier joining, the edges should be formed with a slightly tapering form so that the housing element having the housing recess can initially be arranged relatively imprecisely opposite the housing projection and then guided towards this, and the two housing elements can be fixed in place with increasing precision by means of the diagonal edge surfaces as the feeding movement progresses. The projection edges should be formed in such a way as to be higher in the feeding direction than other positive-locking elements, such as, for example, attachment tabs on one housing element which mesh with tab recesses in the other housing element, so that initially a relatively coarse positioning of the two housing elements can be made by means of the housing recess and the housing projection, and the tabs do not have to be brought to mesh with the corresponding recesses for covering until a later phase of the feeding movement by single-axis sliding.

Furthermore, with the invention under consideration, an electric heating device is proposed with a heater housing with at least one slot that extends in a circulation chamber through which a medium that is to be heated can flow and that is formed for holding heat-generating elements, namely for holding a number of such elements in the direction of the length of the slot, one behind the other. The slot will normally form outer walls around which the medium that is to be heated flows on both sides. A development in which the slot forms only one wall around which the medium flows is, however, also conceivable. Preferably considered as a slot is a development in which interior sides that lie opposite each other are provided at a right angle or virtually at a right angle to each other and between them free a type of gap into which the at least one heat-generating element can be inserted so that its exterior sides have a good connection to the interior sides of the slots. The heat-generating elements have at least one PTC heating element, strip conductors that lie flat on it on both sides and a frame that forms a frame opening for holding the at least one PTC element and that surrounds this PTC element. Preferably the slot is formed in such a way that a number of the heat-generating elements already introduced in the preceding can be introduced into the slot, along the length of the slot, one behind the other. With a view to the most uniform heat emission possible across the entire length of the slot, the invention under consideration proposes that spacing surfaces be formed upstream or downstream of the at least one PTC heating element by the heat-generating elements in the lengthwise direction of the slot, by means of which adjacent heat-generating elements are kept at a distance from one another. Preferably the spacing surfaces lie directly on one another, but in any case at a small distance apart from one another, so that the spacing surfaces give the desired distance between adjacent heat-generating elements.

The spacing surfaces are preferably formed by a housing which also forms the frame for holding the at least one PTC heating element.

According to a further preferred development of the heating device according to the invention, the spacing surfaces are formed by a circumferential rim which protrudes beyond the slot at a right angle to its long side. With this rim there results a limit stop, which hits against the upper edge of the slot when the heat-generating elements are slid into the slot and which consequently holds the heat-generating element in the slot at a predetermined penetration depth. The heat-generating elements are furthermore kept at a distance from one another lengthwise in a predetermined manner by the upstream or downstream spacing surfaces. Corresponding to these spacing surfaces, additional bearing surfaces can be provided on the housing of the heating device, upstream or downstream in the direction of the length of the slot, so that the lateral distance of the first or last heat-generating element in the slot can be determined by placing the respective spacing surface of the heat-generating element against the heater housing, and so that in any case at least a minimum lateral distance is maintained.

For the heat-generating elements the respective heat-generating elements of the present invention are most preferred to use as part of the inventive heating device.

With the further claimed method for manufacturing an electric heating device of the aforementioned type results a manufacturing method in which the at least one heat-generating element can be slid into the slot in a predetermined manner so that the heat-generating element is arranged in the heater housing in a defined manner, which is advantageous in view of uniform heating and also in view of a defined electrical connection of contact studs of the heat-generating element, which normally protrude beyond the upper side of the slot, to insertion elements that are mounted on both sides of a printed circuit board, for example.

The plate already mentioned in the preceding and arranged between the wedge element and the at least one PTC heating element serves to compensate the manufacturing tolerances in the method according to the invention, so that, with the method according to the invention, ceramic PTC heating elements that can have various thicknesses in an identical batch due to the manufacture can be economically used for manufacturing an electric heating device by means of using identical frames or housings.

Further details and advantages of the invention under consideration result from the following description of embodiments, in conjunction with the drawing. This drawing shows:

DETAILED DESCRIPTION OF THE PREFERRED EMBODIMENTS

Figure 1:
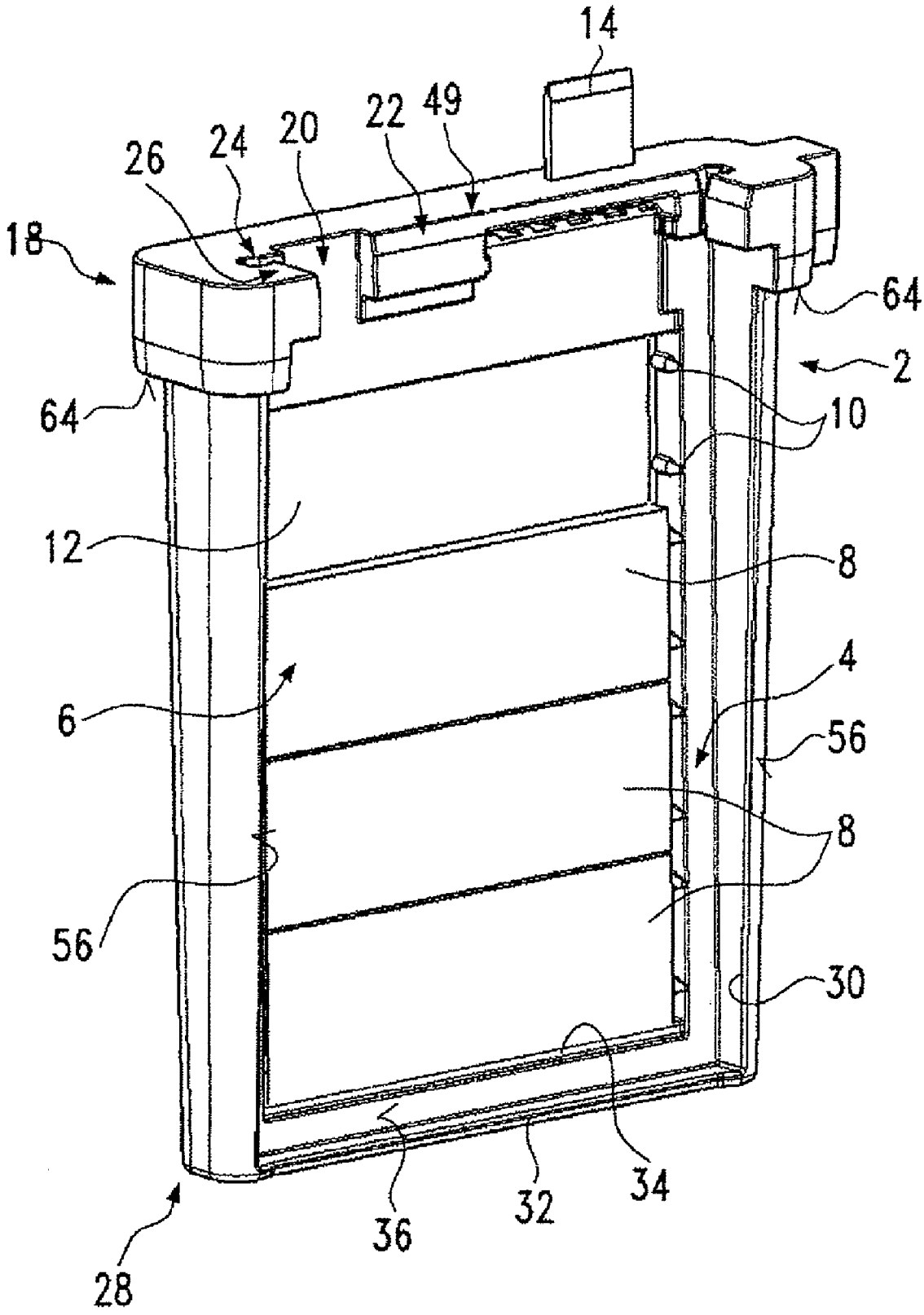
FIG. 1 a perspective side-view of a first, partially assembled embodiment of a heat-generating element before its completion.
Figure 2:
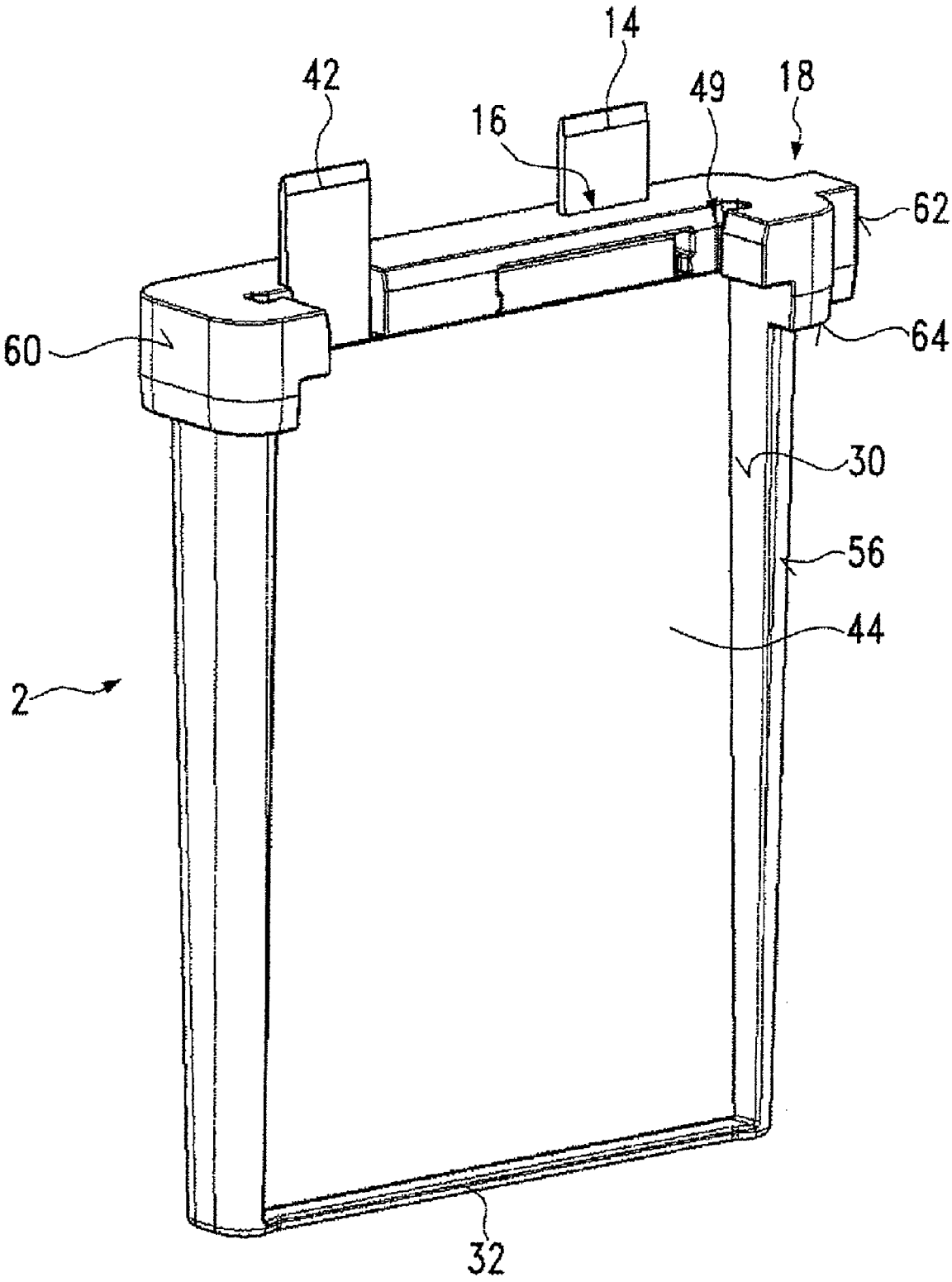
FIG. 2 a view according to FIG. 1 for a further downstream manufacturing step.
Figure 3:
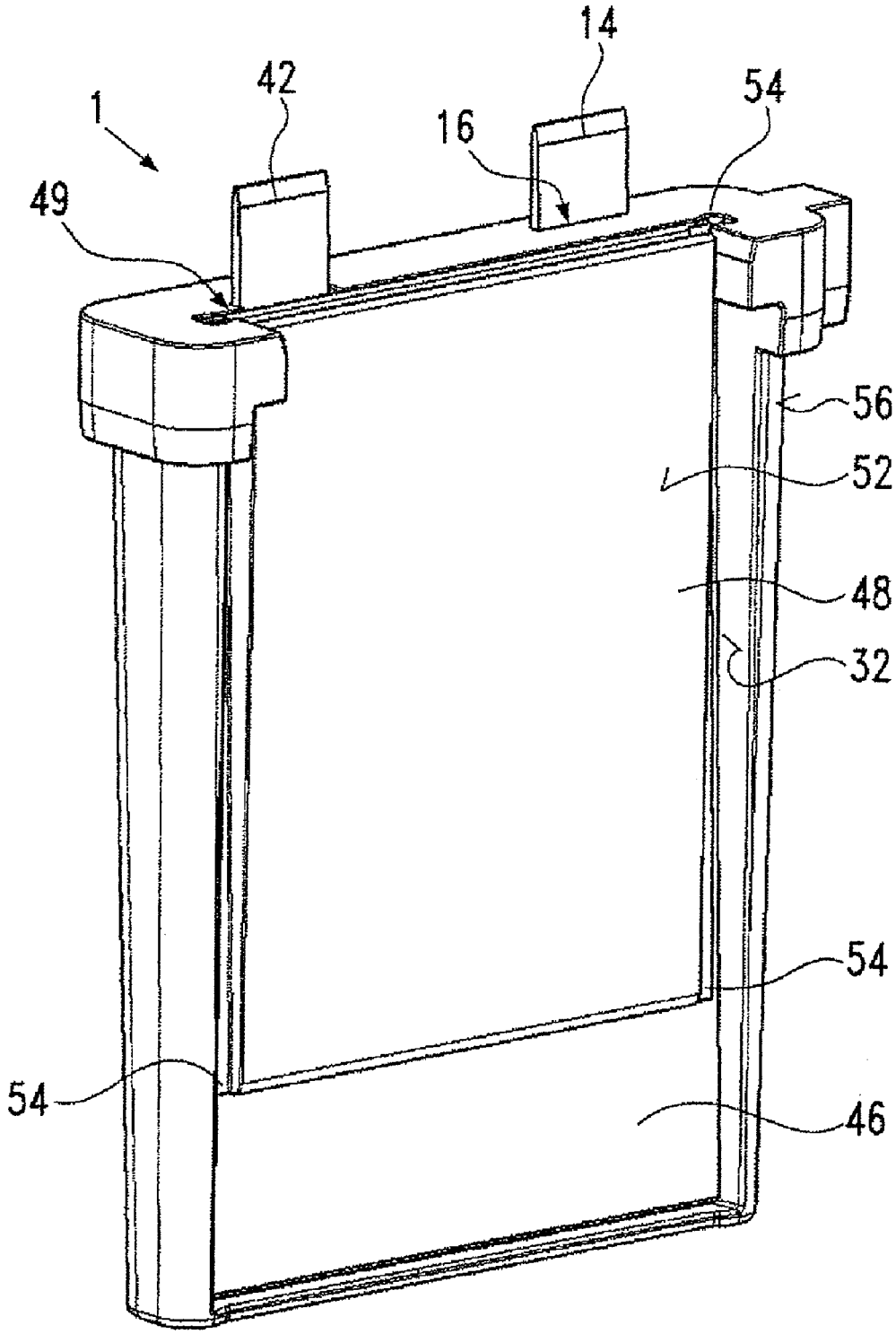
FIG. 3 a view according to FIGS. 2 and 3 after completed assembly of the embodiment of the heat-generating element.

The embodiment shown in FIGS. 1 to 5 is a heat-generating element 1 with a one-piece housing 2, which, in a frontal view (cf. FIG. 4) is formed with a wedge shape narrowing towards the bottom. The housing 2 forms a frame 4 which encloses a frame opening 6 in which four PTC heating elements 8 can be held in this case, whereby only three PTC heating elements 8 are shown in FIG. 3. The four PTC heating elements 8 arranged one above the other in a level are held at a distance from the wall of the frame 4 by means of pins 10, which are formed from a highly insulating material, for example a silicone bonded to the plastic of the housing 2 by means of injection molding the material of the housing 2 around the pins 10, whereby said material has better insulating characteristics against leakage currents than does the plastic material of the housing 2. The pins can also be joined to the housing 2 at their base by means of one-piece injection molding and can be covered with a highly-insulating sleeve made of ceramic or a highly insulating plastic.

The PTC heating elements 8 lie on a strip conductor which, in the shown embodiment, is formed by a metal sheet 12 connected to the housing 2 uniformly by means of injection molding around said strip conductor. The metal sheet 12 has an essentially rectangular cross-section and is cut out, by means of stamping, at its upper end to form a contact stud 14. The contact stud 14 protrudes through a contact stud opening 16, which surrounds the contact stud 14 around the circumference and is formed when the metal sheet 12 is injection moulded around by the plastic material that flows around the contact stud 14.

Figure 4:
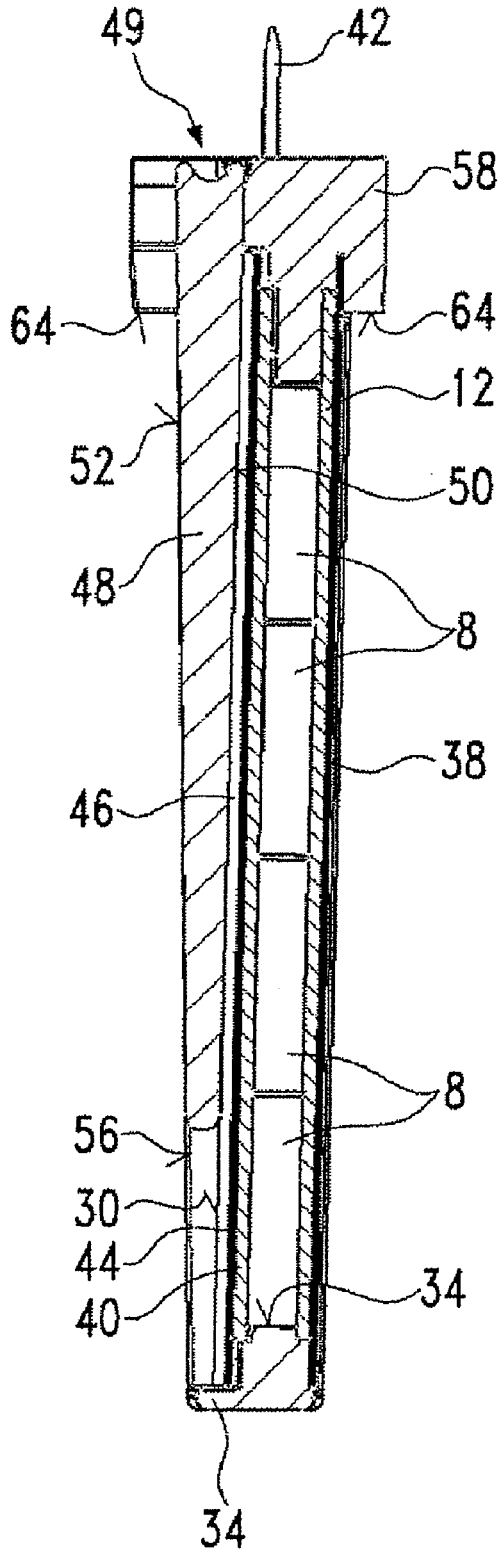
FIG. 4 a cross-sectional view of the embodiment shown in FIG. 3.

On the upper face side 18 of the housing 2 through which the contact stud 14 protrudes, a further contact stud opening 20 is cut out that opens towards the side surface of the housing 2 and that will be discussed in more detail in the following. Furthermore, a guide 22 with guide grooves 24 opens towards the upper face side 18 of the housing 2 for a wedge element that is described in detail later and that is not shown in FIG. 1. A lateral guiding surface of the guide grooves 24 is formed by the surface of the frame 4. The opposing guiding surface of the guide grooves 24 is formed by a guide ridge 26 which projects beyond this first guiding surface and which is formed by the housing 2. The guide ridge 26 extends essentially across the entire height of the housing, i.e., from the upper face side 18 to a lower face side 28. Located on the lower face side 28 is a front wall 32 which connects opposing flanks 30 of the housing 2 and which closes off the guide grooves 24 at the bottom. As the sectional view in FIG. 4 illustrates, a lower wall 34 of the frame 4, said wall bordering the frame opening 6 at the bottom, lies higher than the front wall 32. Highly-insulating pins can also be placed upstream of this lower wall 34, whereby these pins prevent direct contacting of the lower PTC heating element 8 with the lower wall 34.

Between the lower wall 34 and the lower end of the housing 2, the frame 4 forms a bearing surface 36 for a metal sheet not shown in FIG. 1. On the opposite side, the metal sheet 12 can be overlapped by a part formed by injection molding around and consequently firmly secured on the housing 2.

As can be seen in the sectional view in FIG. 4, a ceramic plate 38 lies on the exterior of the metal sheet 12 as an insulating layer, said metal sheet 12 also being connected to the housing 2 by means of injection molding the thermoplastic material of the housing 2 around metal sheet 12.

The frame 4 and the metal sheet 12 and ceramic plate 38 elements connected to the housing 2 consequently form, with the frame opening 6, a receptacle, closed on one side, for the PTC heating elements 8. The PTC heating elements 8 can be simply inserted into this receptacle where they are initially fixed in a stationary position.

In a further manufacturing step indicated in FIG. 2, a further metal sheet 40 is then positioned on the side of the PTC heating element 8 opposite the metal sheet 12, whereby this metal sheet 40 is provided with a contact stud 42. The contact stud 42 in this case is inserted into the further contact stud opening 20 from the exterior. This further metal sheet 40 is also surrounded on the exterior by a ceramic plate 44 which lies flat against the further metal sheet 40 and protrudes from this on the exterior. The ceramic plate can be sealed with respect to the housing 2, particularly by means of a highly-insulating sealing strip that surrounds the further metal sheet 40 on all sides and that is made of a highly-insulating plastic, whereby this sealing strip preferably has adhesion characteristics and lies on the surface of the frame 4 that surrounds the frame opening 6. In this way leakage currents are prevented from being introduced into the plastic of the housing 2 via the further metal sheet 40. For the same reasons, the other metal sheet 12 can also be dimensioned in such a way that it only covers the PTC elements 8, with the metal sheet 12 and the ceramic plate 38, however, being held in place solely by injection molding around of the ceramic plate 38. The electrically conductive parts of the heat-generating element, i.e., the two metal sheets 12, 40 and the PTC heating elements 8 are then in any case supported within the frame opening in a highly-insulated manner. Leakage current between the two metal sheets 12, 40 via the plastic material of the frame 4 must subsequently not be feared. The heat-generating element is therefore particularly suitable for operation with high voltages, for example, in a voltage range of between 100 volts and 400 volts.

In the framework of the further assembly, a slide plate 46 is then positioned on the exterior against the ceramic plate 44, whereby the slide plate 46 has dimensions roughly corresponding to the dimensions of the ceramic plate 44 and it covers and supports the ceramic plate 44 on the exterior.

After the further metal sheet 40, the ceramic plate 44 and the slide plate 46 have been inserted, from the side, against the frame 4 and into the housing 2, a wedge element 48 is slid, from the upper face side 18, into the housing 2 through an insertion opening 49 cut into this housing 2. The wedge element has a first wedge surface 50, which in this case is laid against the slide plate 46 on the exterior, and a second wedge surface 52, which is formed oblique to the first wedge surface 50, namely with a slope that essentially corresponds to the tapering development of the housing 2 in the insertion direction of the wedge element 48. Guide ridges 54 project beyond the face surfaces of the wedge element that connects the two wedge surfaces 50, 52, whereby these guide ridges 54 are formed on the wedge element 48 and fit into the guide grooves 24.

In the embodiment shown, the guide grooves 24 run parallel to the layer composition that is held in the housing and that comprises the PTC elements 8, the metal sheets 12, 40 that lie on both sides of them and, in this case, the ceramic plates 38, 44, as well as the slide plate 46. When the wedge element 48 is slid along the guide 2 in the direction towards the lower face side 28, the individual layers of the layer composition do not lie against one another with pressure, at least in the shown embodiment. Such an arrangement is nevertheless conceivable. It should be ensured here, however, that with any oblique placement of the guide grooves 26 relative to the layer composition or, due to the wedge-shaped development of the wedge element 48, this element lies as much as possible across the entire surface on the layer composition and across the entire height of the layer composition, so that each of the PTC elements 8 which lie one above the other is pressed against the strip conductors 12, 40 lying on the outside of them as uniformly as possible.

Figure 5:
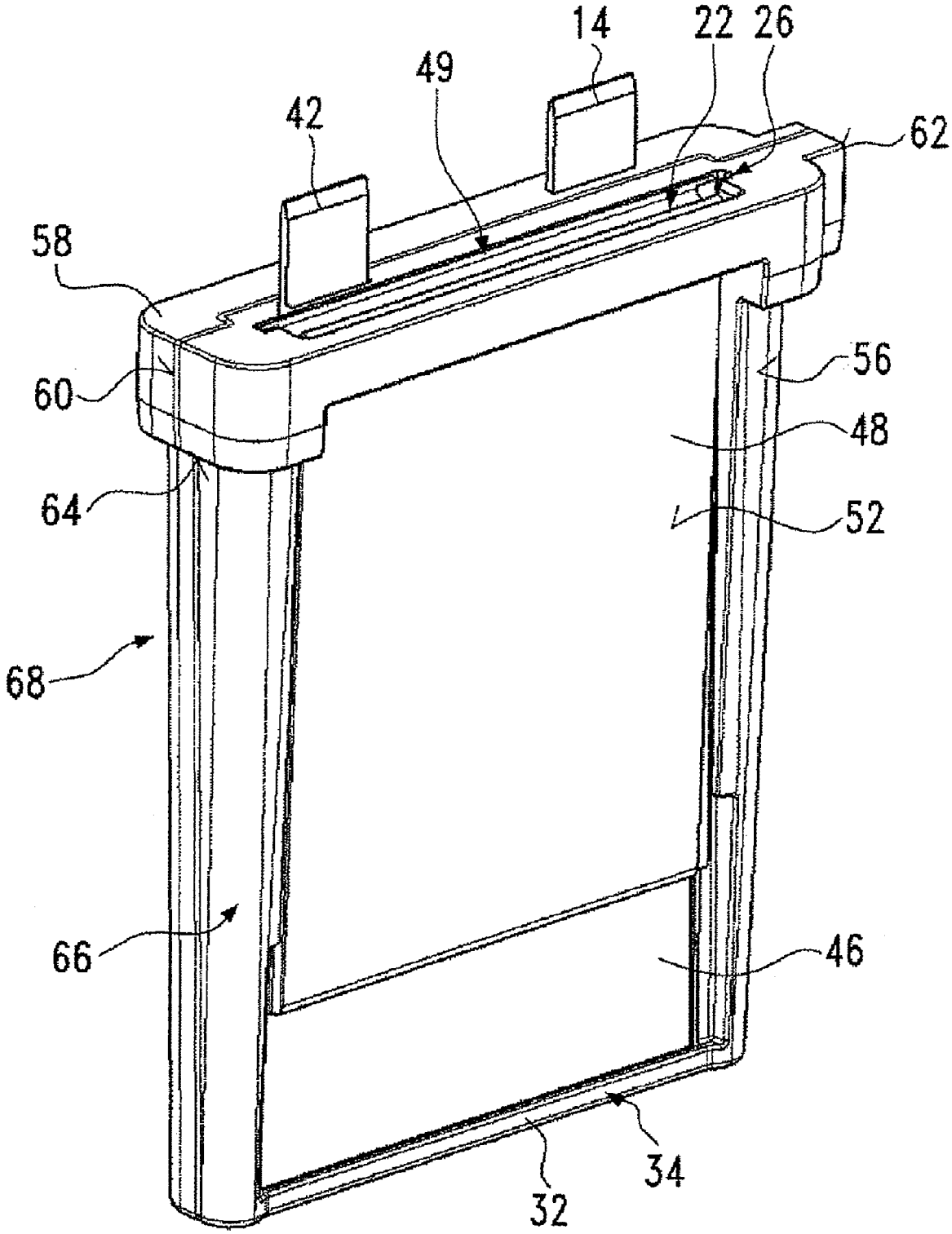
FIG. 5 a perspective side-view of a second embodiment of a heat-generating element.

The wedge element 48 is shown in FIGS. 4 and 5 in its so-called holding position, in which the wedge element 48 secures the layer composition in the housing 2 so that it does not fall out, but does not yet, however, protrude beyond the housing 2 exterior with its second wedge surface 52. In other words, in the holding position, the preassembled heat-generating element is held as a unit by the wedge element 48. The individual components in this case cannot fall away from one another or be lost. In its holding position, the wedge element 48 extends across a little more than three quarters of the length of the assigned strip conductor 40, which is held in position in this way, and holds the PTC elements 8 stacked one above the other in the insertion direction. In this holding position, the wedge element 48 does not protrude from the housing 2, but is, for example, because of the friction forces between the guide grooves 24 and the guide ridges 54, clamped in the housing 2 in a stationary manner.

The heat-generating element 1 preassembled in this way consequently has an exterior contour essentially given by the housing 2, with only the contact studs 14, 42 protruding from this contour. A rear exterior side surface 56 of the housing 2 that borders the flanks 30 accordingly also forms the exterior contour of the heat-generating element 1 at the exterior surface on the side of the wedge element.

In the area of the upper face side 18, the housing 2 forms a circumferential rim 58 which protrudes towards the exterior with respect to the contour of the housing 2 in the area of the PTC heating elements 8 and forms the spacing surfaces 60, 62 upstream or downstream of the PTC elements 8 with respect to their length, whereby these spacing surfaces 60, 62 are formed corresponding to one another, here as flat spacing surfaces on the front side. In the transverse direction, i.e., the direction of the thickness, of the PTC elements, this circumferential rim forms the side surface 56 on the housing side of the limit stops 64 that protrude beyond the ceramic plate 38 on the exterior, whose function will be explained in more detail in the following. The limit stops 64 extend at a right angle to the contact studs 14, 42, i.e., at a right angle to the layer composition held in the housing 2.

FIGS. 5 to 8 show a further embodiment of a heat-generating element. Components that are the same as those in the already discussed embodiment are identified with the same reference numbers.

The essential difference between the embodiment of FIGS. 1 to 4 and the embodiment now being discussed consists of the fact that the housing 2 in the embodiment being discussed is formed here as a two-piece housing with a housing shell 66 and a housing counter-element 68 formed in a shell-shape corresponding to the housing shell 66. Both of these housing elements 66 and 68 are formed by means of injection molding, being attached to said housing elements 66, 68 respectively by injection molding around each holds the ceramic plate 38, 44 and the metal sheet 12, 40. The housing shell element shown in FIG. 6 furthermore forms the guide 22 for the wedge element 48, which is, however, formed like the guide of the first embodiment.

Figure 6:
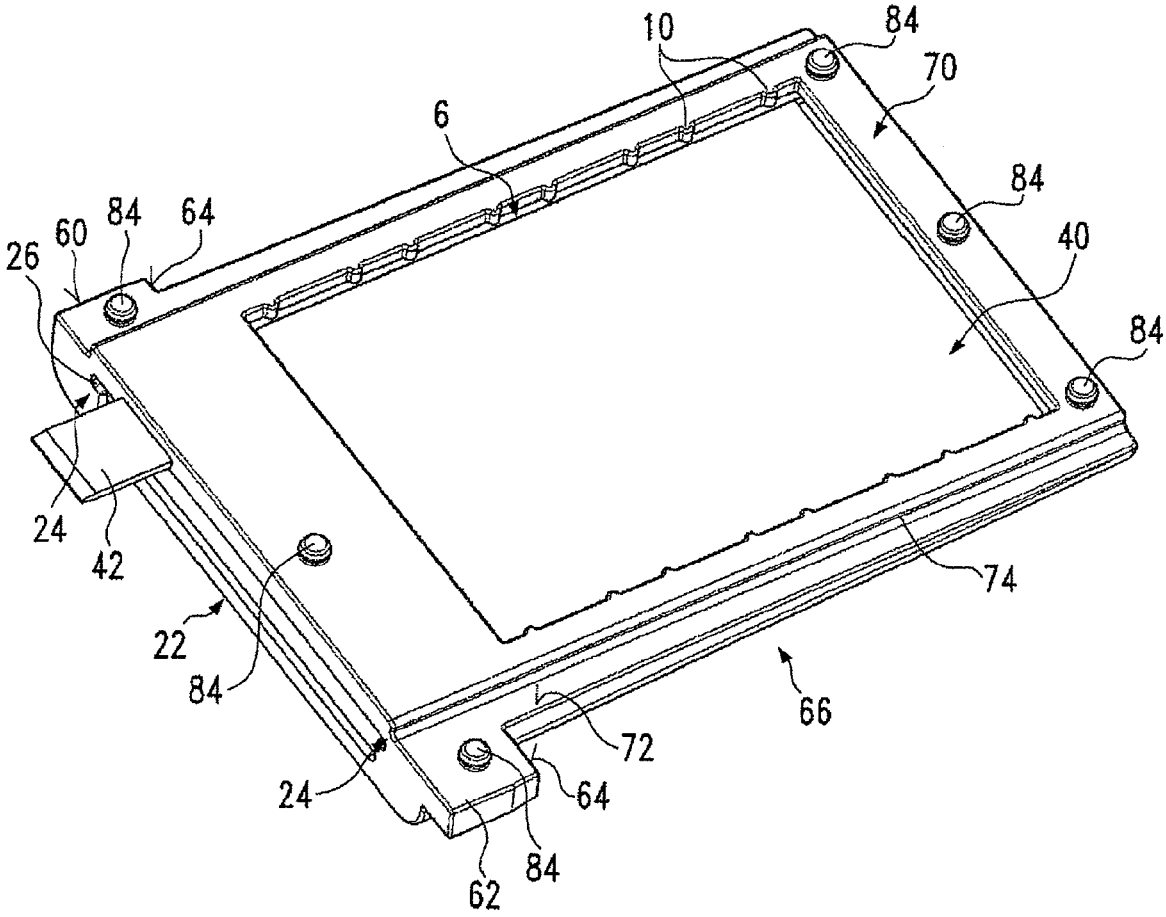
FIG. 6 a perspective top view on to a first housing element of the embodiment shown in FIG. 5.

The housing shell element 66 shown in FIG. 6 has a housing projection 70 that surrounds the frame opening 6, which housing projection protrudes an essentially level rim-side bearing surface 72 of the housing shell element 66. The housing projection 70 is bordered by projection edges 74 that run in the insertion direction and that are formed so that they run towards each other in a slightly tapering manner.

Figure 7:
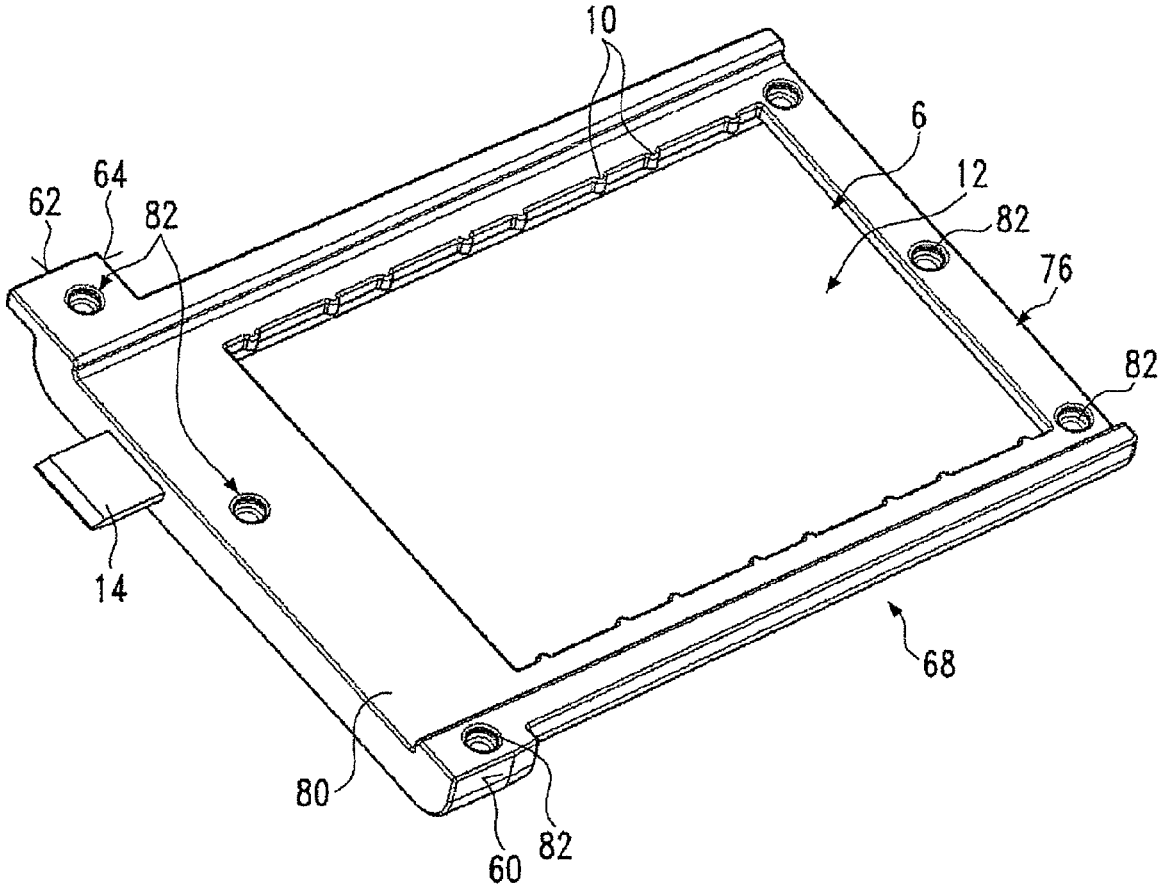
FIG. 7 a perspective top view on to a second housing element of the embodiment shown in FIG. 5, which is formed complementarily to the element shown in FIG. 6.
Figure 8:
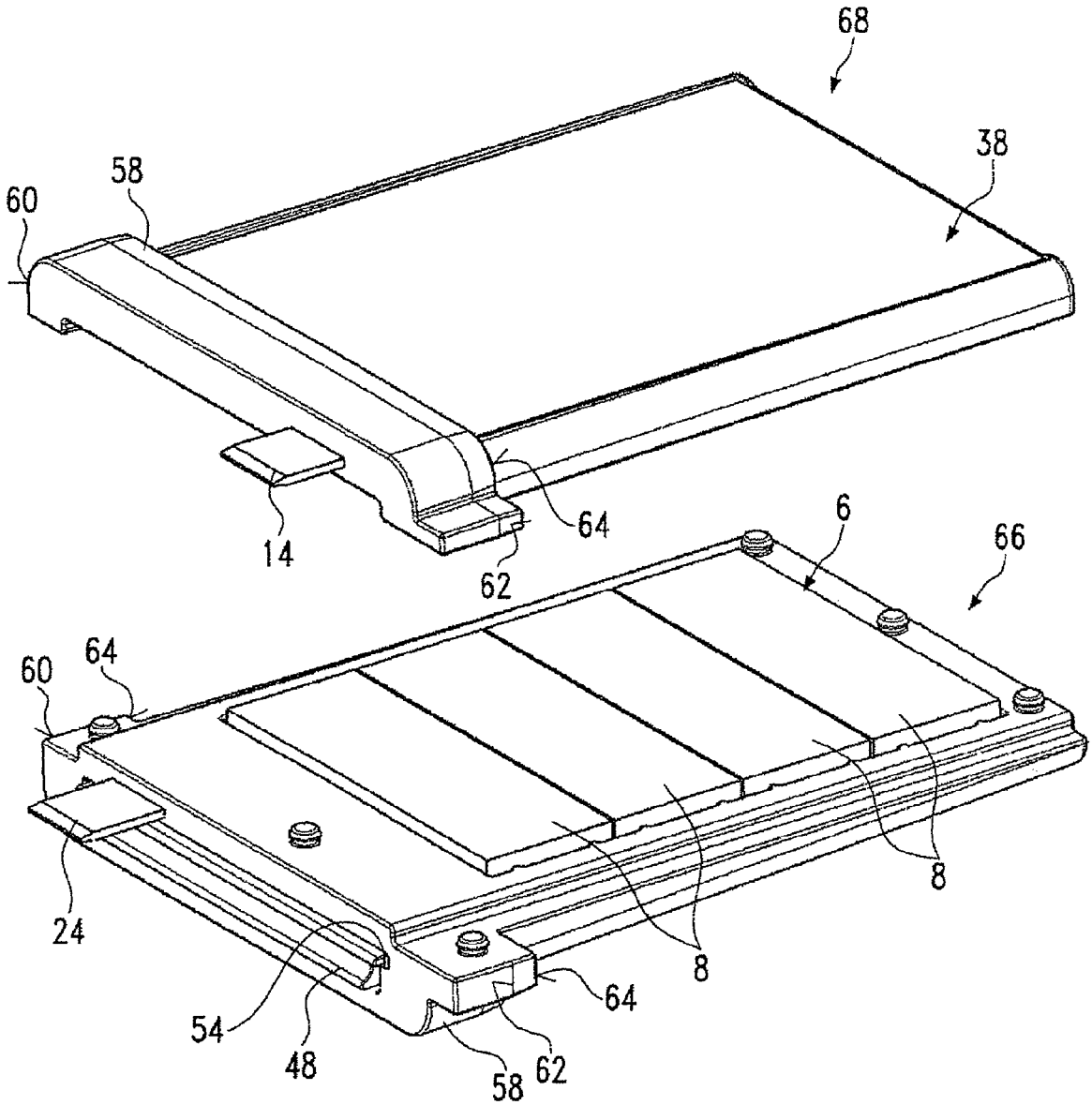
FIG. 8 a perspective top view on to the two housing elements shown in FIGS. 6 and 7, before the joining of these elements.

The housing counter-element 68 shown in FIG. 7 has a housing recess 76 formed corresponding to the housing projection 70. Its exterior bearing surface 80 has tab recesses 82 that correspond to the tabs 84 of the housing shell element 66, which protrude beyond the bearing surface 72 or the upper side of the housing projection 70.

In the embodiment shown in FIGS. 5 to 8, the respective ceramic plates 38, 44, together with the metal sheets 12, 40, are attached to the housing elements 66, 68 by means of injection molding around the metal sheets 1, 2, 40 and are held in these elements as a single unit. Furthermore injection molding is used to effect an exterior sealing of the frame 4, which is predominantly formed when the housing elements are joined (cf. FIG. 8) by the housing shell element 66 and, to a less extent, by the housing counter-element 68.

A sealing strip, not shown in the drawing, can be provided between the housing shell element 66 and the housing counter-element 68. This can, for example, be provided surrounding the housing opening 6 between the housing projection 70 and the corresponding opposite surface of the housing shell counter-element 68. The compressibility of the sealing element is selected in such a way that, even given certain manufacturing tolerances with regard to the thickness of the PTC heating elements 8, a reliable sealing of the frame opening 6 is achieved. The relative movement of the two housing elements at a right angle to the plane of the layer composition that is needed for this is guided by the meshing of tabs 84 and tab recesses 82. The tabs 84 can lock in engagement into the tab recesses 82, so that the housing elements 66, 68 are undetachably held with respect to one another, but are still movable with respect to one another. The housing elements 66, 68 that are equipped with the PTC heating elements 8 are, however, in the context of the invention, already joined into a single unit component when the tabs mesh with one another and thus prevent the housing elements 66, 68 from sliding freely against one another.

Figure 9:
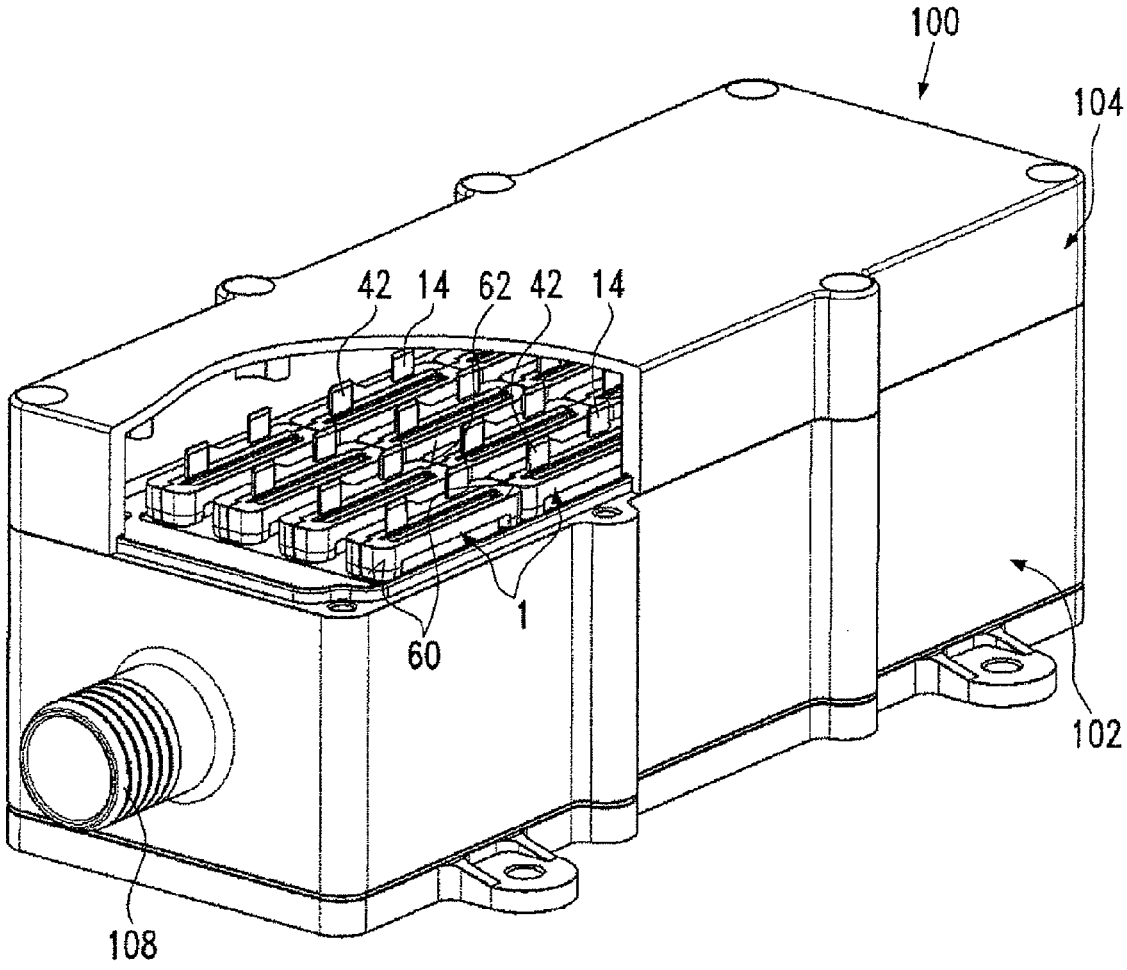
FIG. 9 a perspective diagonal view of an embodiment of an electric heating device that was created using a number of heat-generating elements according to the embodiment in FIG. 5.
Figure 10:
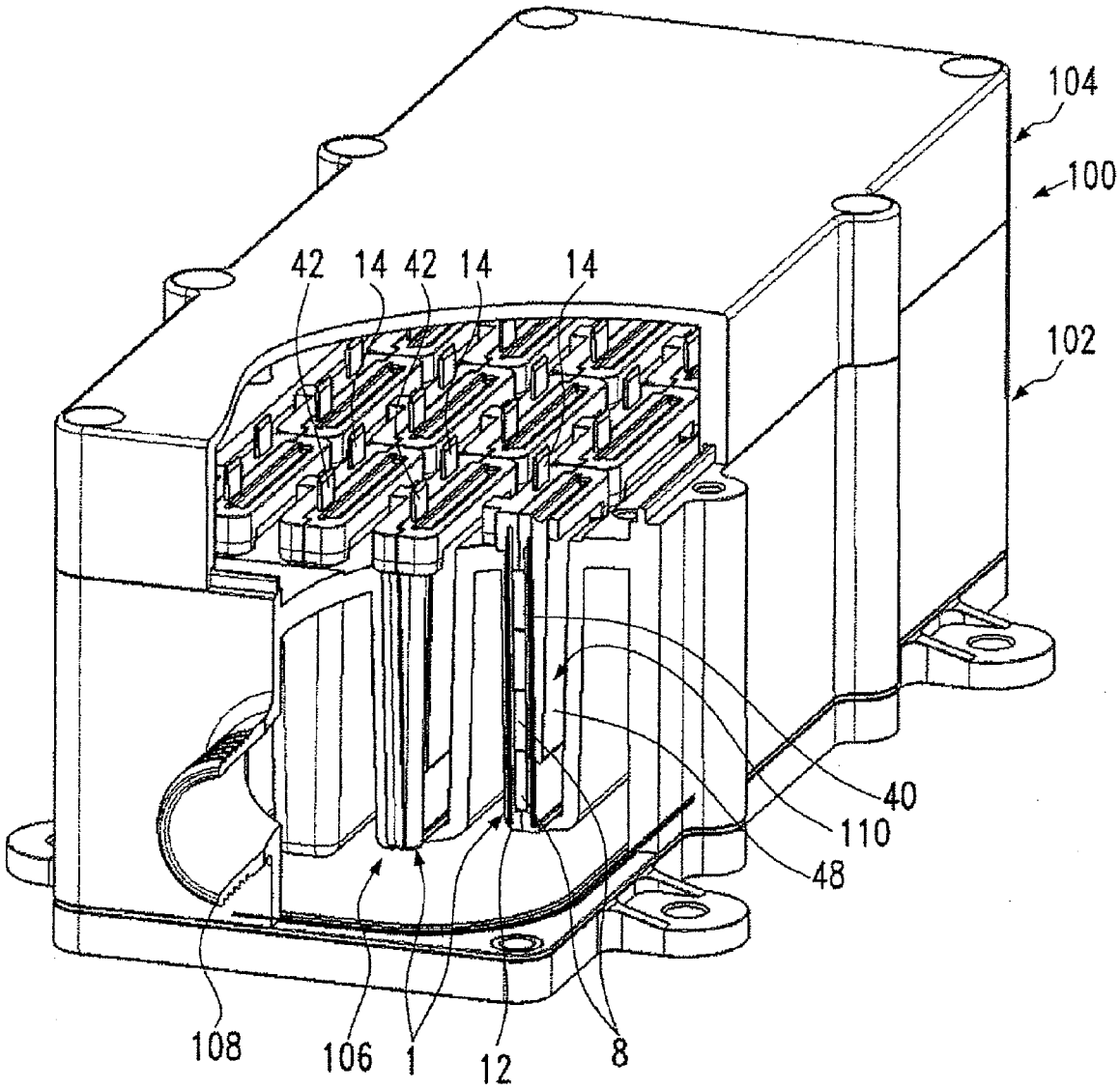
FIG. 10 the perspective depiction shown in FIG. 9 with the heater housing partially removed.
Figure 11:
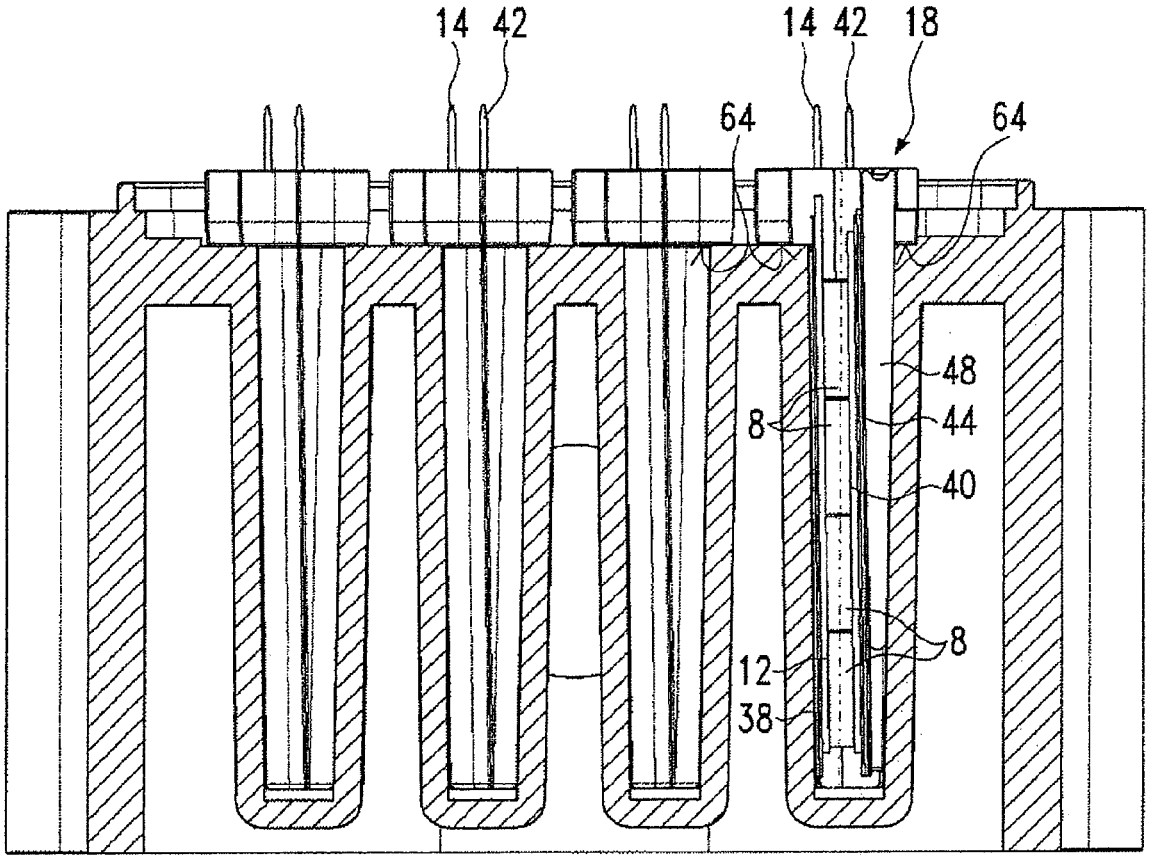
FIG. 11 a cross-sectional view through the embodiment shown in FIG. 9 and FIG. 12 a partially cut side view of the embodiment shown in FIG. 9.
Figure 12:
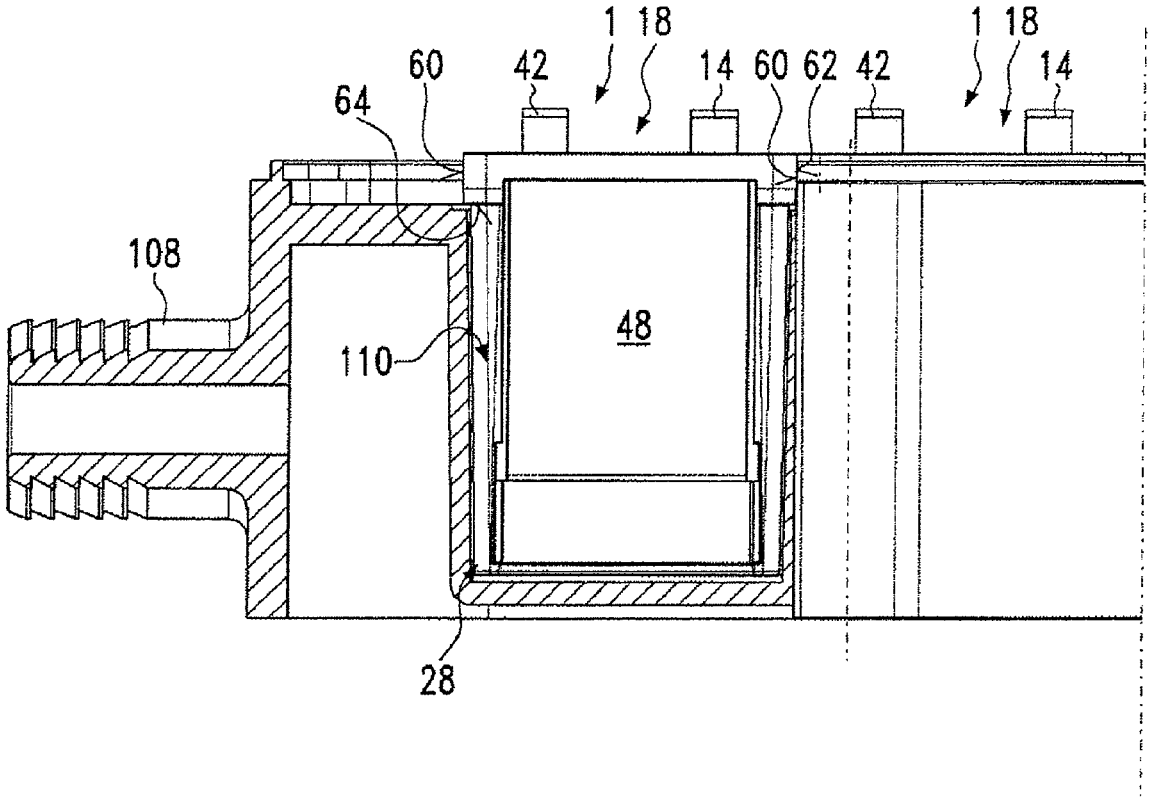

FIGS. 9 to 11 show an embodiment of an electric heating device with a heater housing 100 with a housing base 102 and a housing cover 104. The housing base 102 has a circulation chamber 106 which is connected to a line for the fluid to be heated via connections, of which only one connection 108 is shown. The circulation chamber 106 is penetrated by a number of slots 110 that extend along the direction of the length of the housing base 102, whereby these slots 110 have an essentially U-shaped cross-sectional shape in the cross-sectional view and are circumferentially closed with respect to the circulation chamber 106. These slots 110 have a depth that is greater than the extension of the previously mentioned heat-emitting elements in the insertion direction of the wedge element 48. The shown embodiment of an electric heating device has four slots arranged one next to the other that extend essentially across the entire length of the housing base 102. The housing base 102 is formed as a die-cast part made of aluminium.

With the housing cover 104 removed, a number of heat-generating elements 1 are introduced next to one another in each of the individual slots 110, namely to such a depth that the limit stops 64 bump into the edge of the slot 110 at the top. The lateral distance between adjacent heat-generating elements 1 is maintained by corresponding spacing surfaces 60, 62 abutting one another. After a single heat-generating element 1 has been positioned in the slot 110, the wedge element is slid further forwards in the insertion direction from the holding position. Here the second wedge surface 52 slides outwards over the side surface 56 of the housing 2 and is brought to lie against the aluminium wall of the slot. When the wedge element 48 is slid in with a predetermined insertion force, the heat-generating element 1 is pressed into the slot so that, on the one hand, the wedge element lies with good heat conduction between the interior side of the slot and the topmost layer of the layer composition and on the other hand, the outer layer of the layer composition present on the other side lies directly against the other exterior side of the slot. The movement of the wedge element 48 is guided via the guide 22 in this final assembly of the heating element. Depending on the manufacturing tolerances, particularly the varying thickness of the PTC elements, the wedge element 48 here can be slid into the housing 2 to a depth that can vary. The housing 2 nevertheless remains in the specified position relative to the slot 110, given by the limit stops 64 and the spacing surfaces 60, 62. In the embodiment shown in FIGS. 1 to 4, thickness tolerances of the PTC elements can also be compensated by slide plates 46 of various thicknesses. In the case of the other embodiment of a heat-generating element according to FIGS. 5 to 8, the thickness compensation is handled by means of relative movement of the housing elements 66, 68, guided by means of the meshing of tabs 84 and tab recesses 82.

The heat-generating elements 1 are initially placed with their spacing surface 60 flush against a limit stop formed on the heater housing 100 when inserted into the corresponding slots 110. In this way, the position of each of the first heat-generating elements 1 is given within the slot 110. By means of the contact of the respective spacing surface 60, 62, the position of the next heat-generating element 1 is given in the direction of the length of the respective slot 110. Furthermore, the penetration depth of the heat-generating elements into the respective slot 110 is defined on the basis of the limit stops 64. The heat-generating elements 1 held in this way in the predetermined position in the housing base 102 can be electrically contacted in a simple manner by applying a card with plug connections for the respective contact studs 14, 42. For reasons of clarity, such a card was not shown in FIGS. 9 and 10. One must, however, imagine such a card as a component above the upper face side 18, but below the ends of the contact stud 14 or 42. The contact studs 14, 42 protrude through the card and are electrically contacted to corresponding contact stud receptacles soldered to the card and arranged on the side of the card facing the heat-generating element 1.

The invention claimed is:

1. A heat-generating element comprising:

at least one PTC heating element, strip conductors lying flat on both sides of the at least one PTC heating element, and a frame which forms at least one frame opening for holding the at least one PTC heating element and which surrounds the at least one PTC heating element, wherein the frame is formed as a part of a housing and forms a structural unit with a wedge element, wherein the wedge element comprises 1) a first wedge surface that extends parallel to at least one of the strip conductors and 2) a second wedge surface that is aligned diagonally to the first wedge surface and that is exposed on an exterior side of the housing; and wherein an insertion opening in an upper face side of the housing leads to a guide for the wedge element and has contact stud openings that are penetrated by contact studs leading to the strip conductors, wherein the upper face side of the housing forms spacing elements that extend at right angles to the contact studs, and wherein said spacing elements are formed corresponding to spacing surfaces upstream or downstream of the at least one PTC heating element and extending in the direction of the length of the contact studs.

2. A heat-generating element comprising:

at least one PTC heating element, strip conductors lying flat on both sides of the at least one PTC heating element, and a frame which forms at least one frame opening for holding the at least one PTC heating element and which surrounds the at least one PTC heating element, wherein the frame is formed as a part of a housing and forms a structural unit with a wedge element, wherein the wedge element comprises 1) a first wedge surface that extends parallel to at least one of the strip conductors and 2) a second wedge surface that is aligned diagonally to the first wedge surface and that is exposed on an exterior side of the housing; and wherein the housing comprises a housing shell element and a housing counter-element, each of which is connected to a strip conductor via injection molding around a thermoplastic material forming said housing shell element and said housing counter-element around said strip conductor, respectively and, where appropriate, around an insulating layer provided on the exterior, wherein one of these forms the guide for the wedge element, wherein the housing elements are joined into a structural unit in such a way that they do not move with respect to one another by being meshed in the insertion direction of the wedge element, but in such a way that they are still movable with respect to one another in a direction at least essentially at a right angle to the insertion direction of the wedge element.

3. The heat-generating element according to claim 2, wherein a compressible sealing material is provided between the two housing elements and seals the frame opening.

4. An electric heating device comprising:

a heater housing with at least one slot that extends into a circulation chamber through which a medium that is to be heated can circulate and that holds a number of heat-generating elements along the length, one behind the other;

at least one PTC heating element;

strip conductors lying flat on both sides of the at least one PTC heating element;

a frame which forms at least one frame opening for holding the at least one PTC heating element and which surrounds the same, wherein the heat-generating elements have spacing surfaces upstream and downstream of the at least one PTC heating element in the direction of the length of the slot, whereby adjacent heat-generating elements are spaced at a distance from one another by the spacing surfaces by abutment of the spacing surfaces of adjacent heat-generating elements;

wherein the frame is formed as a part of a housing and forms a structural unit with a wedge element, wherein the wedge element comprises 1) a first wedge surface that extends parallel to at least one of the strip conductors and 2) a second wedge surface that is aligned diagonally to the first wedge surface and that is exposed on the exterior side of the housing; and wherein an upper face side of the housing has an insertion opening that leads to the guide for the wedge element and contact stud openings penetrated by contact studs leading to the strip conductors, and wherein the spacing elements are formed on the upper face side of the housing and extend at right angles to the contact studs, and wherein said spacing elements are formed corresponding to spacing surfaces upstream or downstream of the PTC heating element and extending in the direction of the length of the contact studs.

5. An electric heating device comprising:

a heater housing with at least one slot that extends into a circulation chamber through which a medium that is to be heated can circulate and that holds a number of heat-generating elements along the length, one behind the other;

at least one PTC heating element;

strip conductors lying flat on both sides of the at least one PTC heating element;

a frame which forms at least one frame opening for holding the at least one PTC heating element and which surrounds the same, wherein the heat-generating elements have spacing surfaces upstream and downstream of the at least one PTC heating element in the direction of the length of the slot, whereby adjacent heat-generating elements are spaced at a distance from one another by the spacing surfaces by abutment of the spacing surfaces of adjacent heat-generating elements;

wherein the frame is formed as a part of a housing and forms a structural unit with a wedge element, wherein the wedge element comprises 1) a first wedge surface that extends parallel to at least one of the strip conductors and 2) a second wedge surface that is aligned diagonally to the first wedge surface and that is exposed on the exterior side of the housing; and wherein the housing comprises a housing shell element and a housing counter-element, each of which is connected to a strip conductor by injection molding around a thermoplastic material forming said housing shell element and said housing counter-element around said strip conductor, respectively and, where appropriate, around an insulating layer provided on the exterior, wherein one of these forms the guide for the wedge element, and wherein the housing elements are joined into a structural unit in such a way that they do not move with respect to one another by being meshed in the insertion direction of the wedge element, but in such a way that they are still movable with respect to one another in a direction essentially at a right angle to the insertion direction of the wedge element.

6. The electric heating device according to 5, wherein a compressible sealing material is provided between the two housing elements and seals the frame opening.

* * * * *